US012157857B1

(12) United States Patent
Aamir et al.

(10) Patent No.: US 12,157,857 B1
(45) Date of Patent: Dec. 3, 2024

(54) METHOD FOR PREPARING HYDROCARBON-ENRICHED OIL

(71) Applicant: KING FAISAL UNIVERSITY, Al-Ahsa (SA)

(72) Inventors: Muhammad Aamir, Al-Ahsa (SA); Muhammad Hassan, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/588,522

(22) Filed: Feb. 27, 2024

(51) Int. Cl.
*C10G 1/08* (2006.01)

(52) U.S. Cl.
CPC ..... *C10G 1/086* (2013.01); *C10G 2300/1014* (2013.01)

(58) Field of Classification Search
CPC ..... C10G 1/086; C10G 2300/1014
See application file for complete search history.

(56) References Cited

U.S. PATENT DOCUMENTS 9,169,442 B2 * 10/2015 Huber ..... C10G 1/002
2013/0232853 A1 * 9/2013 Peterson ..... C07G 1/00 568/426
2023/0194449 A1 6/2023 Xiao et al.

OTHER PUBLICATIONS

Zhou et al. (Upgrading of liquid fuel from fast pyrolysis of biomass over modified Ni/CNT catalysts, 2014, Fuel Processing Technology, vol. 126, pp. 12-18). (Year: 2014).*
Minghao Zhou et al, "Upgrading of liquid fuel from fast pyrolysis of biomass over modified Ni/CNT catalysts"; Oct. 2014 Fuel Processing Technology 126:12-18, DOI: 10.1016/j.fuproc.2014.04.015.
Bingzhi LilUet al, "Effects of reaction parameter on catalytic hydrothermal liquefaction of microalgae into hydrocarbon rich bio-oil"; Journal of the Energy Institute vol. 94, Feb. 2021, pp. 22-28.

* cited by examiner

*Primary Examiner* — Youngsul Jeong
(74) *Attorney, Agent, or Firm* — Nath, Goldberg & Meyer; Joshua B. Goldberg

(57) ABSTRACT

A method for producing a hydrocarbon enriched bio-oil can include producing lignin from equal proportions of wheat straw and corn stover, pyrolyzing the lignin in the presence of an inert gas to provide a bio-oil; adding a nickel-impregnated carbon nanotube (Ni-CNT) catalyst to the bio-oil to provide a mixture; and heating the mixture to provide a hydro-carbon enriched bio-oil.

12 Claims, 1 Drawing Sheet

METHOD FOR PREPARING HYDROCARBON-ENRICHED OIL

BACKGROUND

1. Field

The present disclosure relates to a method of producing bio-oil and, particularly, to a method of producing a hydrocarbon enriched bio-oil from lignin.

2. Description of the Related Art

The world currently faces an enormous problem due to the ongoing depletion of fossil fuels while demands for these fuels are ever increasing. Petrochemicals provide both an energy source and a component of most raw materials used in many industries. In fact, approximately 95% of all chemicals manufactured today are derived from petroleum. However, this heavy reliance upon fossil fuels is creating harm to the environment. The burning of these fossil fuels has led to the pollution of air, water, and land, as well as global warming and climate changes.

With the depletion of readily available oil reserves across the globe, a reduction and conservation of fossil fuels is clearly needed. Some alternatives to fossil fuels for providing energy, like solar power, wind power, geothermal power, hydropower, and nuclear power, are used to a degree. However, a more efficient use of renewable resources is always being sought.

Biomass includes plant and wood biomass, including agricultural biomass. Oil produced from biomass, referred to herein as bio-oil, can be a sustainable alternative source of energy. More specifically, the biorefining of biomass into derivative products typically produced from petroleum can help to stop the depletion of petroleum, or at least reduce the current demand for and dependence on petroleum. Biomass can become a key resource for chemical production in much of the world. Biomass, unlike petroleum, is renewable. Biomass can provide sustainable substitutes for petrochemically derived feedstocks used in existing markets.

Biomass is made up primarily of cellulose, hemicellulose, and lignin. These components, if economically separated from one another, can provide vital sources of chemicals normally derived from petrochemicals. The use of biomass can also be beneficial with agricultural and/or woody plants that are sparsely used and plant wastes that currently have little or no use. Biomass can provide valuable chemicals and reduce dependence on coal, gas, and fossil fuels, in addition to boosting local and worldwide economies.

Thus, a method for producing bio-oil solving the aforementioned problems is desired.

SUMMARY

In an embodiment, the present subject matter relates to a method for producing a hydrocarbon enriched bio-oil, the method comprising producing lignin from equal proportions of wheat straw and corn stover; pyrolyzing the lignin in the presence of an inert gas to provide a bio-oil; adding a nickel-impregnated carbon nanotube (Ni-CNT) catalyst to the bio-oil to provide a mixture; and heating the mixture to provide the hydro-carbon enriched bio-oil.

According to an embodiment, a method for producing a hydrocarbon enriched bio-oil can include producing lignin from equal proportions of wheat straw and corn stover; pyrolyzing the lignin in the presence of nitrogen gas at a temperature ranging from about 400° C. to about 600° C. to provide a bio-oil; adding a nickel-impregnated carbon nanotube (Ni-CNT) catalyst to the bio-oil to provide a mixture; and heating the mixture to provide a hydro-carbon enriched bio-oil.

These and other features of the present subject matter will become readily apparent upon further review of the following specification.

DETAILED DESCRIPTION OF THE PREFERRED EMBODIMENTS

Figure 1:
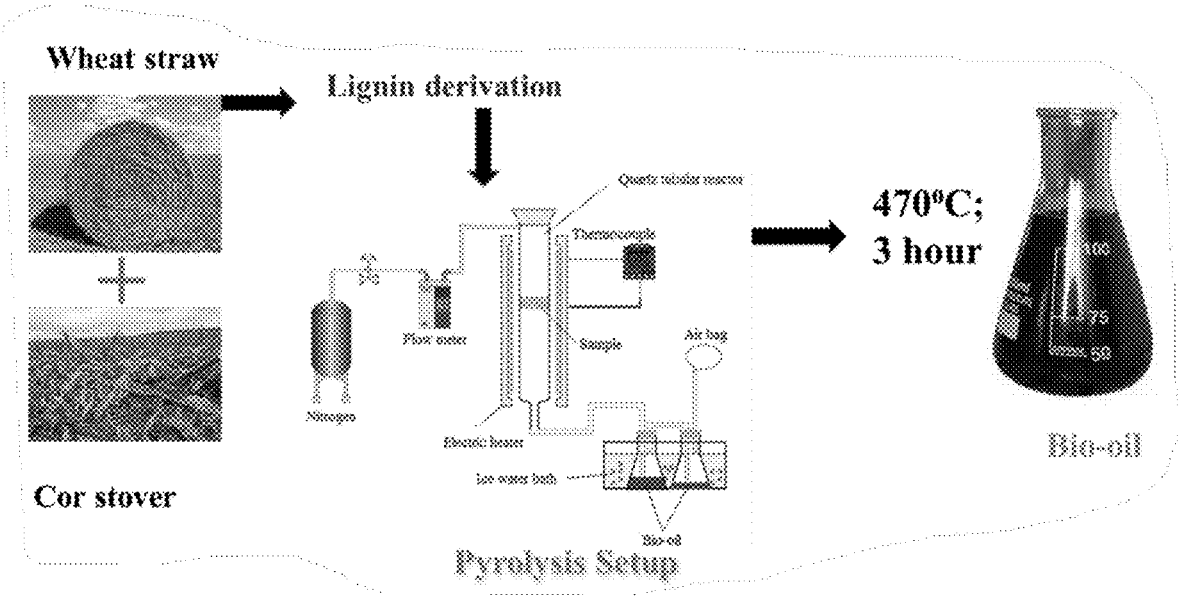
FIG. 1 is a schematic diagram depicting production of bio-oil using pyrolysis.
Figure 2:
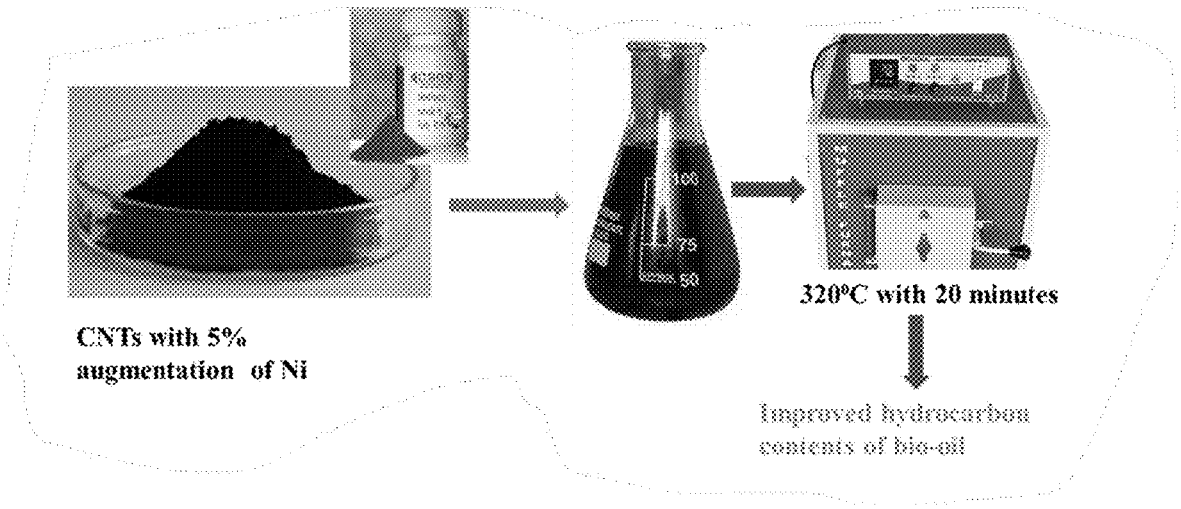
FIG. 2 is a schematic diagram depicting hydrocarbon enrichment of the bio-oil using the CNT-Ni catalyst.

The following definitions are provided for the purpose of understanding the present subject matter and for construing the appended patent claims.

Definitions

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

For purposes of better understanding the present teachings and in no way limiting the scope of the teachings, unless otherwise indicated, all numbers expressing quantities, percentages or proportions, and other numerical values used in the specification and claims, are to be understood as being modified in all instances by the term "about". Accordingly, unless indicated to the contrary, the numerical parameters set forth in the following specification and attached claims are approximations that may vary depending upon the desired properties sought to be obtained. At the very least, each numerical parameter should at least be construed in light of the number of reported significant digits and by applying ordinary rounding techniques.

In an embodiment, the present subject matter relates to a method for producing a hydrocarbon enriched bio-oil, the method comprising producing lignin from equal proportions of wheat straw and corn stover; pyrolyzing the lignin in the presence of an inert gas to provide a bio-oil; adding a nickel-impregnated carbon nanotube (Ni-CNT) catalyst to the bio-oil to provide a mixture; and heating the mixture to provide the hydro-carbon enriched bio-oil.

According to an embodiment, the lignin can be pyrolyzed at a temperature ranging from about 400° C. to about 600° C. In an embodiment, the inert gas can be nitrogen gas. In one embodiment, the lignin can be pyrolyzed at about 470° C. using nitrogen as the inert gas in the pyrolysis chamber.

According to an embodiment, the mixture can include about 2% to about 7% by weight of the catalyst. For example, the mixture can include about 2%, about 3%, about 4%, about 5%, about 6%, or about 7% by weight of the catalyst to provide a bio-oil hydrocarbon enrichment of about 08%, about 14%, about 18%, about 23%, about 27%, and about 29%, respectively. In an embodiment, the nickel-impregnated carbon nanotube (Ni-CNT) catalyst comprises about 5% nickel (Ni).

In an embodiment, the mixture can be heated to a temperature ranging from about 300° C. to about 400° C. for about 10 minutes to about 30 minutes. In one embodiment, the mixture can be heated to a temperature of about 320° C. for about 20 minutes.

According to an embodiment, a method for producing a hydrocarbon enriched bio-oil can include producing lignin from equal proportions of wheat straw and corn stover; pyrolyzing the lignin in the presence of nitrogen gas at a temperature ranging from about 400° C. to about 600° C. to provide a bio-oil; adding a nickel-impregnated carbon nanotube (Ni-CNT) catalyst to the bio-oil to provide a mixture; and heating the mixture to provide the hydro-carbon enriched bio-oil.

Pyrolysis is a thermo-chemical process that converts biomass into energy dense products like syngas, bio-oil, and biochar. The produced bio-oil is typically very rich in terms of its energy contents and can be an ideal competitor of fossil/petroleum diesel in terms of cetane number and its combustion efficiency in internal combustion engines. As described herein, lignocellulosic biomass can be easily converted into bio-oil through pyrolysis. For example, a mixture of wheat straw and corn stover in equal proportions can be utilized to produce lignin. In an embodiment, the lignin can be pyrolyzed at 470° C. using nitrogen as an inert gas in the pyrolysis chamber. After pyrolysis of the lignin, about 43% bio-oil can be achieved on a weight basis.

In an embodiment, a composite catalyst of carbon nanotubes (CNTs) augmented with 5% nickel (Ni) can be added to the bio-oil to provide a mixture including about 2%, 3%, 4%, 5%, 6%, or 7% by weight of the catalyst. The resulting mixture can be heated to about 320° C. for about 20 minutes. The hydrocarbon contents of the bio-oil can be increased with increased concentration of catalyst. For example, the bio-oil hydrocarbon enrichment was found to be 08%, 14%, 18%, 23%, 27%, 29% higher as compared with control for 2%, 3%, 4%, 5%, 6%, 7% catalyst added respectively.

The present subject matter can be better understood by referring to the following examples.

EXAMPLES

Example 1

Preparation of Hydrocarbon-Enriched Bio-Oil

A mixture of wheat straw and corn stover in equal ratio was utilized to produce lignin. The produced lignin was pyrolyzed at 470° C. using nitrogen as an inert gas in the pyrolysis chamber (FIG. 1). After the pyrolysis, 43% bio-oil was achieved on weight basis from the derived lignin.

For determining the chemical composition of the bio-oil, GC-MS (gas chromatography mass spectrometry) analysis was carried out. The GC-MS analysis yielded 13% by weight monocyclic aromatic hydrocarbons (MAHs), 38% by weight polycyclic aromatic hydrocarbons (PAHs), 12% by weight alkanes/alkanes: while the other species included hydroxyls, furans, acids, phenols, esters, aldehydes, and ketones. The main energy dense content of the bio-oil are MAHs, PAHs and alkanes/alkenes which constitute about 63% by weight, cumulatively.

As the main objective of the method was to enhance the cumulative energy contents of bio-oil, a composite catalyst of carbon nanotubes (CNTs) augmented with 5% nickel (Ni) was prepared through the impregnation method. The prepared catalyst was added in the bio-oil at 2%, 3%, 4%, 5%, 6%, 7% to provide a mixture and the mixture was heated to 320° C. with 20 minutes of reaction time in a muffle furnace. The hydrocarbon contents of the resulting bio-oil was found to be increased with increased concentration of the catalyst. The bio-oil hydrocarbon enrichment was found to be 08%, 14%, 18%, 23%, 27%, 29% higher as compared with control the control for 2%, 3%, 4%, 5%, 6%, 7% of catalyst added, respectively. The results of the hydrocarbon enrichment analysis of the bio-oil are presented in the Table below.

TABLE 1

| The bio-oil enrichment contents due to the invented catalyst (CNT-Ni) | | |
|---|---|---|
| Catalyst dose in % (CNT-Ni) | Hydrocarbon contents (MAHs + PAHs + Alk) enhancement due to catalyst (%) | Bio-oil enriched hydrocarbon contents (cumulative) |
| 0 | 0 | 63 |
| 2 | 08 | 68.04 |
| 3 | 14 | 71.82 |
| 4 | 18 | 74.34 |
| 5 | 23 | 77.49 |
| 6 | 27 | 80.01 |
| 7 | 29 | 80.27 |

It is to be understood that the present methods and products are not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A method for producing a hydrocarbon enriched bio-oil, the method comprising:

producing lignin from equal proportions by weight of wheat straw and corn stover;

pyrolyzing the lignin in the presence of an inert gas to provide a bio-oil having about 13% by weight monocyclic aromatic hydrocarbons (MAHs), about 38% by weight polycyclic aromatic hydrocarbons (PAHs), and about 12% by weight alkanes/alkanes;

adding a nickel-impregnated carbon nanotube (Ni-CNT) catalyst to the bio-oil to provide a mixture, the mixture having about 2% to about 7% by weight of the catalyst; and heating the mixture to provide a hydro-carbon enriched bio-oil.

2. The method of claim 1, wherein the lignin is pyrolyzed at a temperature ranging from about 400° C. to about 600° C.

3. The method of claim 1, wherein the lignin is pyrolyzed at about 470° C.

4. The method of claim 1, wherein the inert gas is nitrogen gas.

5. The method of claim 1, wherein the mixture is heated to a temperature ranging from about 300° C. to about 400° C. for about 10 minutes to about 30 minutes.

6. The method of claim 1, wherein the mixture is heated to a temperature of about 320° C. for about 20 minutes.

7. The method of claim 1, wherein the nickel-impregnated carbon nanotube (Ni-CNT) catalyst comprises about 5% nickel (Ni).

8. A method for producing a hydrocarbon enriched bio-oil, the method comprising:

producing lignin from equal proportions by weight of wheat straw and corn stover;

pyrolyzing the lignin in the presence of nitrogen gas at a temperature ranging from about 400° C. to about 600° C. to provide a bio-oil having about 13% by weight monocyclic aromatic hydrocarbons (MAHs), about 38% by weight polycyclic aromatic hydrocarbons (PAHs), and about 12% by weight alkanes/alkanes;

adding a nickel-impregnated carbon nanotube (Ni-CNT) catalyst to the bio-oil to provide a mixture, the mixture having about 2% to about 7% by weight of the catalyst; and heating the mixture to provide the hydro-carbon enriched bio-oil.

9. The method of claim 8, wherein the lignin is pyrolyzed at about 470° C.

10. The method of claim 8, wherein the mixture is heated to a temperature ranging from about 300° C. to about 400° C. for about 10 minutes to about 30 minutes.

11. The method of claim 8, wherein the mixture is heated to a temperature of about 320° C. for about 20 minutes.

12. The method of claim 8, wherein the nickel-impregnated carbon nanotube (Ni-CNT) catalyst comprises about 5% nickel (Ni).

* * * * *